US007743583B2

(12) United States Patent
Kozel et al.

(10) Patent No.: US 7,743,583 B2
(45) **Date of Patent: *Jun. 29, 2010**

(54) METHOD FOR PROVIDING STRUCTURE HAVING MULTIPLE INTERWOVEN STRUCTURAL MEMBERS ENHANCED FOR RESISTANCE OF MULTI-DIRECTIONAL FORCE

(76) Inventors: Michael Kozel, 256 Columbia Ave., Kensington, CA (US) 94708; David Alexander Wilson, 767 San Diego Rd., Berkeley, CA (US) 94707

( * ) Notice: Subject to any disclaimer, the term of this patent is extended or adjusted under 35 U.S.C. 154(b) by 0 days.

This patent is subject to a terminal disclaimer.

(21) Appl. No.: 12/490,043

(22) Filed: Jun. 23, 2009

(65) Prior Publication Data

US 2009/0255210 A1 Oct. 15, 2009

Related U.S. Application Data

(63) Continuation of application No. 11/421,589, filed on Jun. 1, 2006, now abandoned.

(51) Int. Cl.
*E04G 21/14* (2006.01)

(52) U.S. Cl. ..... 52/745.09

(58) Field of Classification Search ..... 52/233, 52/286, 236.7, 653.1, 223.7, 223.9, 745.05, 52/745.09

See application file for complete search history.

(56) References Cited

U.S. PATENT DOCUMENTS 1,445,401 A * 2/1923 Lachman ..... 52/668
1,707,858 A * 4/1929 Hurlbert ..... 52/293.2
1,953,460 A * 4/1934 Bernhard ..... 52/233
2,416,162 A * 2/1947 Drake ..... 52/233
2,832,103 A * 4/1958 Bingham ..... 52/302.1
2,877,506 A * 3/1959 Almoslino ..... 52/223.7
3,006,038 A * 10/1961 Sullivan, Jr. ..... 52/236.1
3,378,971 A * 4/1968 Singer et al. ..... 52/263
3,676,969 A * 7/1972 Moore ..... 52/233
3,798,862 A * 3/1974 Stoakes ..... 52/204.591
3,892,097 A * 7/1975 Bain ..... 52/233
3,913,291 A * 10/1975 Dulien et al. ..... 52/396.04
4,047,350 A * 9/1977 Chisum ..... 52/592.6
4,250,677 A * 2/1981 Yablonski ..... 52/233
4,649,683 A * 3/1987 Dolata ..... 52/233
4,694,629 A * 9/1987 Azimi ..... 52/611
4,787,185 A * 11/1988 Gascho ..... 52/233

(Continued)

FOREIGN PATENT DOCUMENTS

JP 6-200571 * 6/1994

(Continued)

*Primary Examiner*—Gary Ann Spahn
(74) *Attorney, Agent, or Firm*—Donald R. Boys; Central Coast Patent Agency, Inc.

(57) ABSTRACT

A structural assembly has a first set of first elongate structural members alternately spaced apart from a second set of second elongate structural members by locking blocks, the first set defining a first plane and the second set defining a second plane forming an intersection at an angle with the first plane, the structural members and locking blocks defining an assembly of adjoined blocks and structural members at the intersection, and a compressive mechanism spanning the assembly of adjoined blocks and structural members at the intersection. Compressing the adjoined blocks and structural members by the spanning compression mechanism locks the blocks and structural members together in a manner to resist applied forces.

6 Claims, 9 Drawing Sheets

U.S. PATENT DOCUMENTS 4,823,528 A * 4/1989 Faw ..... 52/233
4,840,003 A * 6/1989 Lucas et al. ..... 52/233
4,897,299 A * 1/1990 Kawachi et al. ..... 428/131
4,897,955 A * 2/1990 Winsor ..... 47/33
4,901,489 A * 2/1990 Garber ..... 52/233
4,932,178 A * 6/1990 Mozingo ..... 52/223.7
5,010,701 A * 4/1991 Halsey et al. ..... 52/233
5,081,811 A * 1/1992 Sasaki ..... 52/223.13
5,097,558 A * 3/1992 Accorsi et al. ..... 14/73
5,139,845 A * 8/1992 Beckerman et al. ..... 428/117
5,218,801 A * 6/1993 Hereford ..... 52/223.9
5,505,028 A * 4/1996 Giles ..... 52/233
5,685,115 A * 11/1997 Colfer ..... 52/292
5,806,249 A * 9/1998 Helms ..... 52/102
5,809,713 A * 9/1998 Ray ..... 52/223.9
6,189,271 B1 * 2/2001 Christensen ..... 52/233
7,370,452 B2 * 5/2008 Rogers ..... 52/177
7,418,804 B2 * 9/2008 Tokuno et al. ..... 52/223.7
2002/0121055 A1 * 9/2002 Englehart ..... 52/233
2002/0148191 A1 * 10/2002 Hynes ..... 52/729.1
2002/0152700 A1 * 10/2002 Smith ..... 52/289
2003/0205020 A1 * 11/2003 Sumerak ..... 52/664
2003/0230037 A1 * 12/2003 Neal ..... 52/233
2004/0049995 A1 * 3/2004 Rogers ..... 52/177
2004/0177575 A1 * 9/2004 Posselt ..... 52/282.1
2005/0016093 A1 * 1/2005 Buarque De Macedo ... 52/204.1
2005/0257442 A1 * 11/2005 Brown et al. ..... 52/94
2006/0070322 A1 * 4/2006 Nordli ..... 52/233
2007/0094989 A1 * 5/2007 Scheker ..... 52/596
2007/0137122 A1 * 6/2007 Peaco ..... 52/233
2007/0284322 A1 * 12/2007 Reed et al. ..... 211/85.4
2007/0294967 A1 * 12/2007 Posselt ..... 52/233

FOREIGN PATENT DOCUMENTS

WO WO 92/08852 * 5/1992

* cited by examiner

METHOD FOR PROVIDING STRUCTURE HAVING MULTIPLE INTERWOVEN STRUCTURAL MEMBERS ENHANCED FOR RESISTANCE OF MULTI-DIRECTIONAL FORCE

CROSS-REFERENCE TO RELATED DOCUMENTS

The present patent application is a Continuation of patent application Ser. No. 11/421,589 filed on Jun. 1, 2006, now abandoned. The priority application is incorporated herein in its entirety by reference.

BACKGROUND OF THE INVENTION

1. Field of the Invention

The present invention is in the field of construction, pertaining more specifically to the art of framing in construction and methods and apparatus for securing and locking structural members into position, applicable in many areas, such as construction for sub flooring, ceiling, roof, and other framings requiring structural members, and for structures in furniture, containers, models, and temporary shelters, among many other uses.

2. Discussion of the State of the Art

In the field of framing for construction joisting is regularly employed to form a load-bearing floor, roofing, or ceiling framework comprising of multiple structural members laid parallel to one another and fastened to common end plates or beams. A typical structural member defines the elongate member laid with other like members to form a sub-floor, roof, or a ceiling truss. In constructions of differing materials the structural members are laid somewhat uniformly in the arrangements or structures according to certain standards set for those types of constructions. A problem with standard joisting is that it is limited to simple or continuous spans with bearing-type connections and is particularly weak with respect to resisting force from certain directions variant from typical load-bearing (vertical) forces or dead weight.

Depending on construction materials used in a particular project, there are various standard methods for securing structural members to each other and to end plates. Nails, screws, metal bracing, and other components may be used depending on specifications for the construction project. A problem with typical joisting and joisting with prefabricated truss works is that other than vertical load-bearing, there is no inherent structural integrity for resisting certain directional forces that can occur such as wind shear, earthquake, and other forces.

Therefore, what is clearly needed is a structural member lock and positioning system that distributes load resistance to vertical members across the construction and adds structural strength to resist forces other than vertical load forces.

SUMMARY OF THE INVENTION

In an embodiment of the present invention a structural assembly is provided comprising a first set of first elongate structural members alternately spaced apart from a second set of second elongate structural members by locking blocks, the first set defining a first plane and the second set defining a second plane forming an intersection at an angle with the first plane, the structural members and locking blocks defining an assembly of adjoined blocks and structural members at the intersection, and a compressive mechanism spanning the assembly of adjoined blocks and structural members at the intersection. Compressing the adjoined blocks and structural members by the spanning compression mechanism locks the blocks and structural members together in a manner to resist applied forces.

In one embodiment the compressive mechanism comprises a rod, wire or cable passing through aligned openings in the adjoining blocks and structural members at the intersection, and one or more elements applying tension to the rod, wire or cable. Also in one embodiment the structural members and the blocks have complementary shape such that adjoining blocks and structural members engage at a specific angle defined by the engagement shapes of the blocks.

In some embodiments the structural members have an I-beam shape with a central planar member and wider rails at each end, the locking blocks have channels to engage the wider rails, with sets of channels on opposite sides to engage adjacent structural members, with the sets of channels oriented at an angle to one another, defining the angle of the planes at the intersection. Also in some embodiments there may be a third set of structural members defining a third plane parallel to the first plane and a fourth set of structural members defining a fourth plane parallel to the second plane, the first and second planes intersecting at a first intersection at ninety degrees, the second and third planes intersecting at a second intersection at ninety degrees, the third plane and the fourth plane intersecting at a third intersection at ninety degrees, and the fourth plane and the first plane intersecting at a fourth intersection at ninety degrees, the four planes defining a rectangular box.

In some embodiments there panels fastened to the separate sets of structural members, providing a top, a floor, and two sides to the structural assembly.

In another aspect of the invention a method for making a rigid structural assembly is provided, comprising the steps of (a) spacing apart a first and a second set of elongate structural members alternately with locking blocks such that the first set defines a first plane and the second set defines a second plane in an intersection at an angle with the first plane, the structural members and locking blocks defining an assembly of adjoined blocks and structural members at the intersection; and (b) compressing the adjoined structural members and inter-spaced locking blocks at the intersection with a spanning compression mechanism.

In one embodiment of the method the compressive mechanism comprises a rod, wire or cable passing through aligned openings in the adjoining blocks and structural members at the intersection, and one or more elements applying tension to the rod, wire or cable. In another embodiment the structural members and the blocks have complementary shape such that adjoining blocks and structural members engage at a specific angle defined by the engagement shapes of the blocks.

Also in some embodiments of the method the structural members may have an I-beam shape with a central planar member and wider rails at each end, the locking blocks have channels to engage the wider rails, with sets of channels on opposite sides to engage adjacent structural members, with the sets of channels oriented at an angle to one another, defining the angle of the planes at the intersection.

In some embodiments there may be a third set of structural members defining a third plane parallel to the first plane and a fourth set of structural members defining a fourth plane parallel to the second plane, the first and second planes intersecting at a first intersection at ninety degrees, the second and third planes intersecting at a second intersection at ninety degrees, the third plane and the fourth plane intersecting at a third intersection at ninety degrees, and the fourth plane and the first plane intersecting at a fourth intersection at ninety degrees, the four planes defining a rectangular box. Also in some cases there are panels fastened to the separate sets of structural members, providing a top, a floor, and two sides to the structural assembly.

BRIEF DESCRIPTION OF THE DRAWING FIGURES

DETAILED DESCRIPTION

Figure 1:
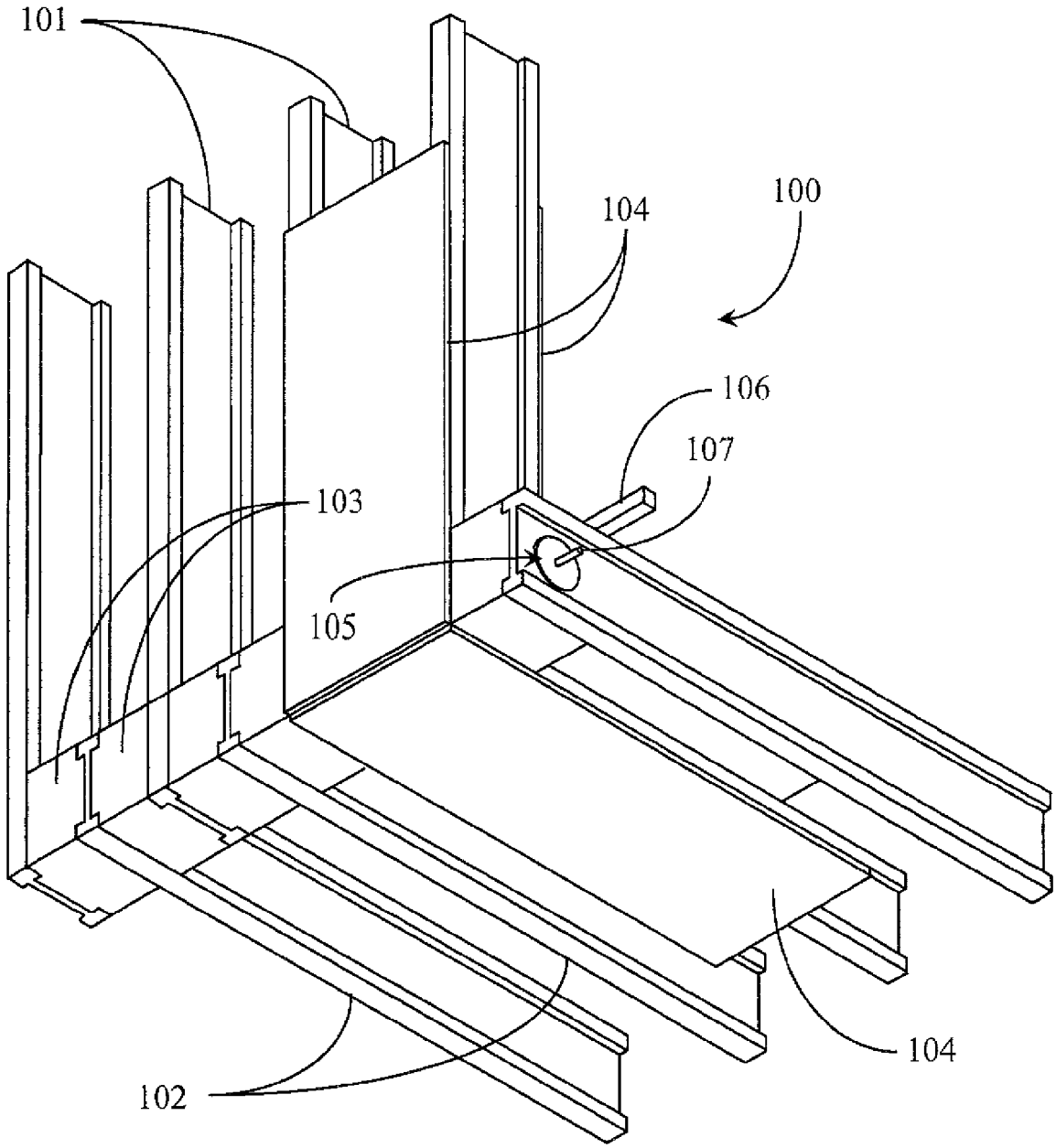
FIG. 1 is perspective view of a frame assembly according to an embodiment of the invention.

FIG. 1 is perspective view of a frame assembly 100 according to an embodiment of the invention. Frame assembly 100 is a framing configuration in construction that provides a construction framing for floors, walls, and ceilings of a structure or building. Assembly 100 consists of multiple structural members 101 and 102 positioned and locked into place by multiple torsion locking blocks 103 placed between each of vertical structural members 101 and horizontal structural members 102. In this example, structural members 101 and 102 are identical to one another in physical description and may be used as either vertical or horizontal members.

Structural members 101 and 102 may be made of wood, steel, aluminum, or some other durable material suitable for building construction. Torsion locking blocks 103 may be made of wood, steel, aluminum, or some other durable material suitable for building construction. Structural members 101 and 102 have physical features that interface and engage with physical features on the joist-interfacing sides of torsion locking devices 103 in this configuration.

In this example there are 4 vertical structural members 101 and 4 horizontal structural members 102 assembled with 7 torsion locking blocks 103. This framing example may represent, for example, a junction of a sub floor and vertical wall framing of a building under construction. It will be appreciated by one with skill in the art of construction that the entire building frame is not represented in this example. In this case the structural members are secured at a right angle (90 degrees), common for floor-to-wall interfaces. The structural members are secured to the locking blocks at their ends in this example. In other construction configurations the angle may differ from 90 degrees and the structural members may intersect with torsion locking blocks at any intersection point placed along the length of those members.

A compression system 105 is provided to compress the collective components of the assembly together in the geometric configuration shown. Compression system 105 comprises a solid and durable elongate bar or rod 107 that passes through openings located in structural members 101 and 102 and in torsion locking blocks 103. System 105 may include compression washers and tensioning nuts applied to the ends of the assembly to secure and compress the assembly together. The elongate rod 107 used may be manufactured of steel or another solid and durable material capable of serving as a compression medium without failing under tensioning applied at the ends of the assembly.

In alternative embodiments cable or wire may be used rather than a rod or bar, and various tensioning mechanisms may be used to compress the structural members and the locking blocks together.

Assembly 100 is superior in strength to other construction geometries using structural members because the torsion locking blocks 103 together with the compression system 105 applied to secure the assembly provide transfer of shear, torsion, and moment forces laterally between adjacent structural members 101 and 102 in a direction substantially perpendicular to the direction of the structural members in the assembly.

Assembly 100 includes multiple exterior and interior panels 104 that help to secure the structural members together with other structural members in the assembly. Panels 104 are attached in this example to the assembly at the outside and inside edges of the structural members. Panels 104 may be manufactured of plywood, metal sheeting, fiberglass sheeting, or other relatively stiff material. Panels 104 help to ensure transfer of shear and moment forces across the assembly, but are not essential in the broad aspects of this invention. Exterior panels 104 come together at the rear edge of the assembly and are fastened to the assembly with the aid of a blocking element 106 (interior blocking element visible).

Blocking elements 106 are positioned both on the exterior and interior sides of the assembly and are connected between the structural members 101 and 102, and torsion locking blocks 103. Blocking elements 106 have fasteners that tie the components together when panels 104 are added to the assembly. Blocking elements 106 provide a continuous load path between the other elements of the assembly and further allow adjacent panels 104 to be connected or secured across their lateral intersection. Blocking elements 106 may be manufactured from wood, steel, aluminum, or some other solid and durable material capable of load transfer.

Figure 2:
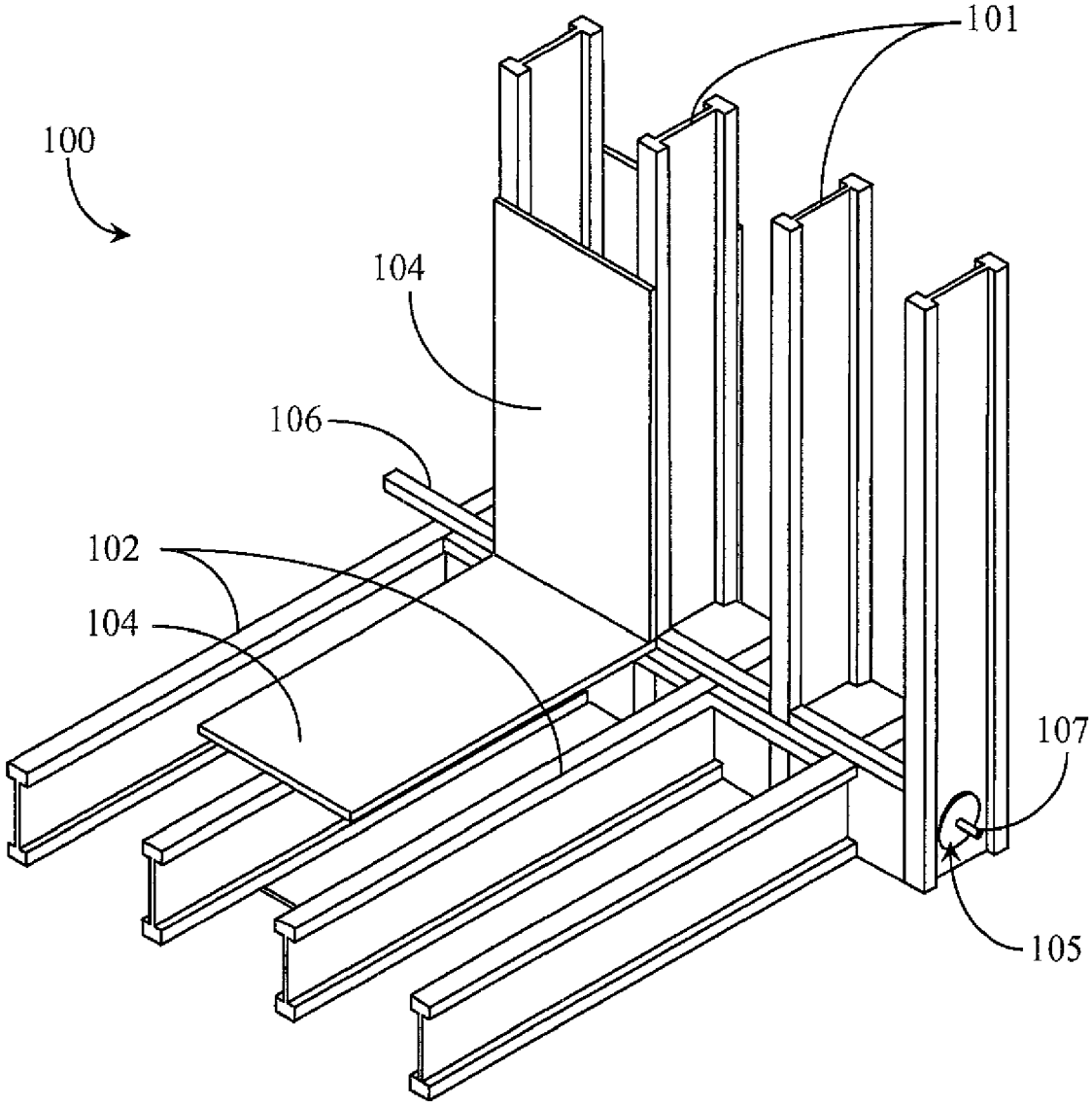
FIG. 2 is a perspective view of the assembly of FIG. 1 flipped around to illustrate the inside construction of the assembly.

FIG. 2 is a perspective view of the assembly of FIG. 1 rotated to illustrate the inside construction of the assembly in this example. In this view blocking elements 106 are visible in position between horizontal structural members 102 and vertical structural members 101. Fasteners holding blocking elements in position and to panels 104 are not visible in this example but are assumed present. The construction and type of fasteners used will depend on the material selection of the components in the assembly. The exact method of fastening is not relevant to the invention.

Figure 3:
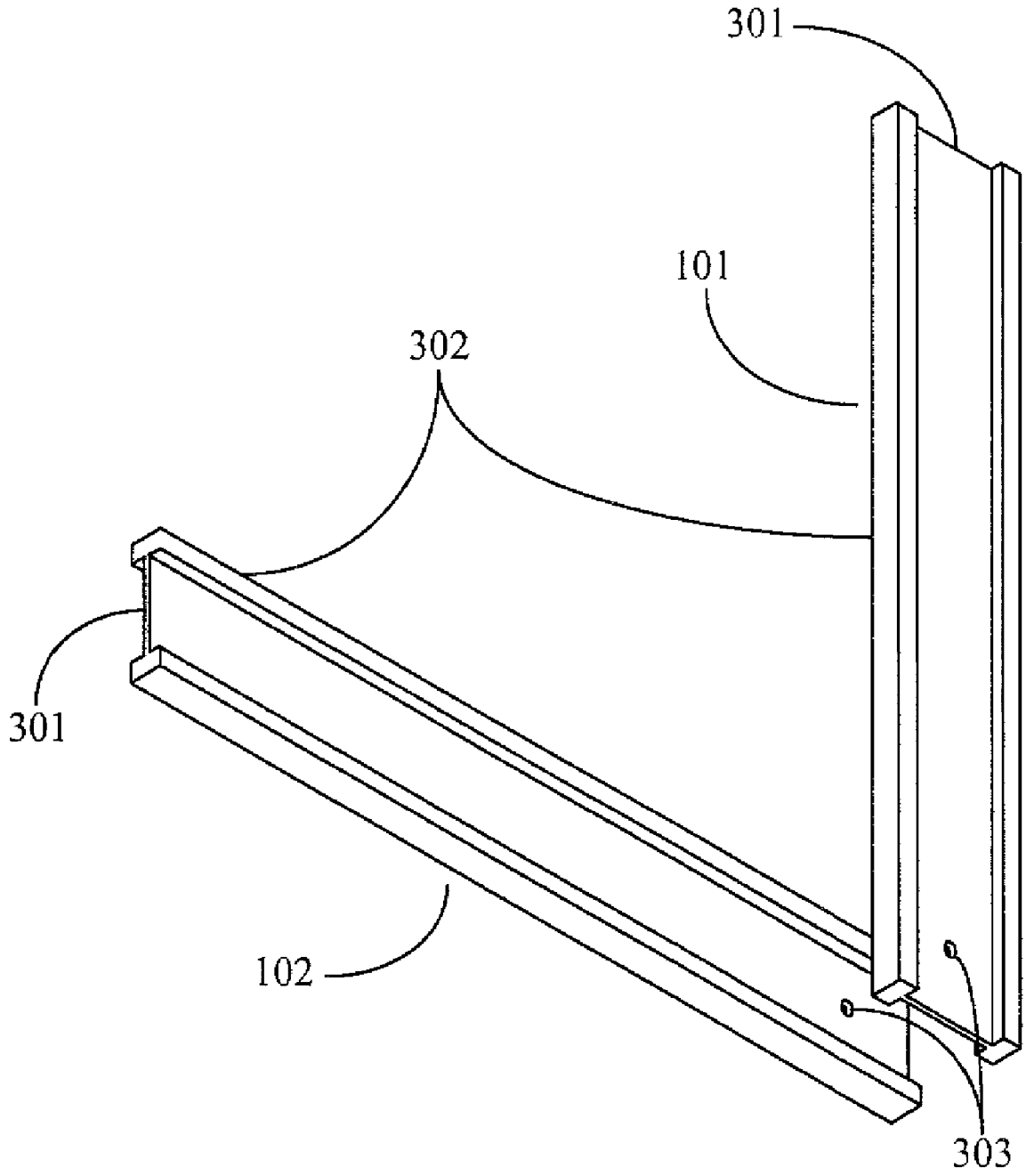
FIG. 3 is a perspective view of the structural members of FIGS. 1 and 2.

FIG. 3 is a perspective view of one each of structural members 101 and 102 of FIGS. 1 and 2, shown isolated. Structural member 101 and structural member 102 are identical to each other in physical description in this embodiment, but may differ somewhat in other embodiments. In this example the shared physical features between structural members 101 and structural members 102 have the same element numbers and description. Each structural member 101 and 102 consists of substantially parallel rails 302 formed along longitudinal edges of the structural members. A thinner middle body 301 is disposed between rails 302 forming a complete structural member much in the manner of an I-beam. In a preferred embodiment, structural members 101 and 102 are contiguous parts formed of the same material. In some embodiments rails 302 may be separate components joined to middle body 301 to form a structural member that may function as a part formed of one material.

In this example, rails 302 are rectangular in profile. The rectangular portion of each rail 302 on one side of body 301 is of a dimension that fits into channels provided on interfacing sides of the torsion locking blocks. The I-beam construction profile of structural members 101 and 102 provides sufficient transfer of load forces and is particularly suited for strength. Structural members 101 and 102 each have openings 303 in alignment with one another in appropriate configuration for assembly with the interspaced locking blocks. Openings 303 are sized to accept the tensioning bar or rod 107.

Structural members 101 and 102 have each have openings 303 at locations along each structural member where a torsion structural member lock may be placed, not necessarily just at the ends of the members. Further, structural members 101 and 102 may be of any required length for construction. The structural members may be assembled using a torsion structural locking block at any desired linear angle including 180 degrees. In one embodiment the angle of construction of the structural members is set by the construction of the torsion structural member locks. For example, a 90-degree angle would require a 90-degree torsion structural member lock.

Figure 4:
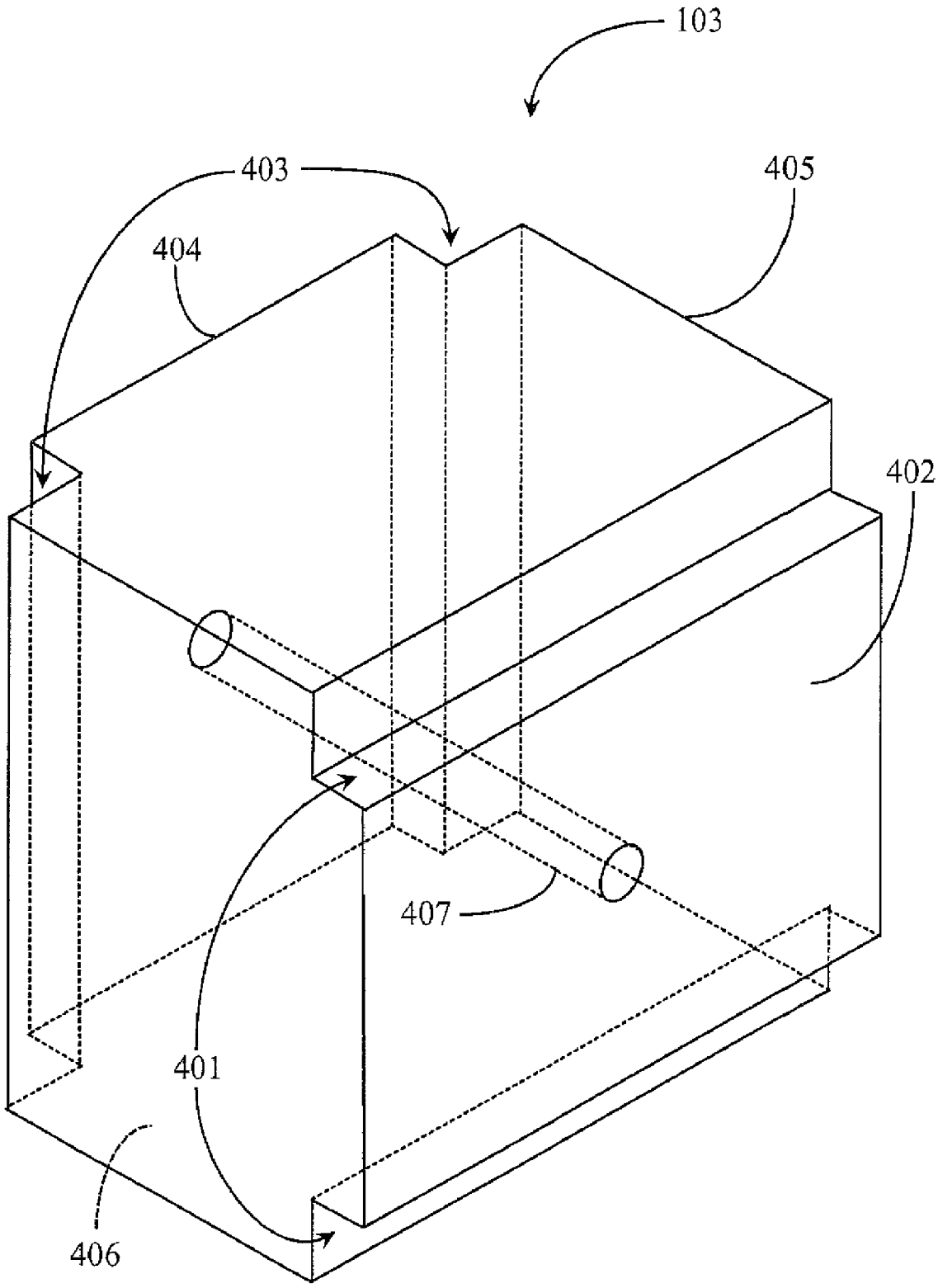
FIG. 4 is a perspective view of the structural member lock of FIG. 1 according to an embodiment of the invention.

FIG. 4 is a perspective view of a torsion locking block 103 of FIG. 1 according to an embodiment of the invention. Torsion locking block 103 may be manufactured of steel, wood, fiberglass, or other construction materials. Locking block 103 in this example is quadrilateral in shape having 4 sides, a top surface and a bottom surface. Sides 402 and 404 are the sides that interface with structural members. Sides 406 and 405 do not interface with structural members. Opposing sides of structural member block 103 are substantially parallel to each other as are the top and bottom surfaces.

In one embodiment torsion locking block 103 is of a solid construction. In another embodiment, locking block 103 may be manufactured of separate components that fit together to function as one piece. One or more openings 407 are provided at or around the approximate center of locking block 103 extending from side 402 through side 404. Opening 407 is a through-bore and has a diameter sufficiently large for accepting the tensioning rod 107, or whatever tensioning element is to be used.

Torsion locking block 103 has a pair of channels 401 along opposing edges of side 402. Channels 401 are identical to one another in depth and function to accept the rails provided on the structural members 101 and 102. Channels 401 are substantially symmetrical and extend the length of side 402 in a horizontal direction for supporting one of horizontal structural members 102 described further above. The spacing between the opposing shelf walls is just small enough to accept the spacing between the inner opposing walls of the rails of a structural member. Channels 401 have a depth measured from surface 402 that is just large enough to enable the structural member body in between the rails to interface flush against surface 402. The fit is tight enough so that there is very little or no movement in the angle of the assembly.

On surface 404 there is a like pair of channels 403 provided in orientation rotated approximately 90 degrees from channels 403 to accept vertical structural members 101 described earlier. In this embodiment, torsion locking block 103 is a 90-degree block, meaning that adjacent structural members abutting the locking block are disposed linearly at a 90-degree angle such as where a floor meets a vertical wall. However, other torsion locking blocks may be provided of varying angles between 0 and 180 degrees.

Figure 5:
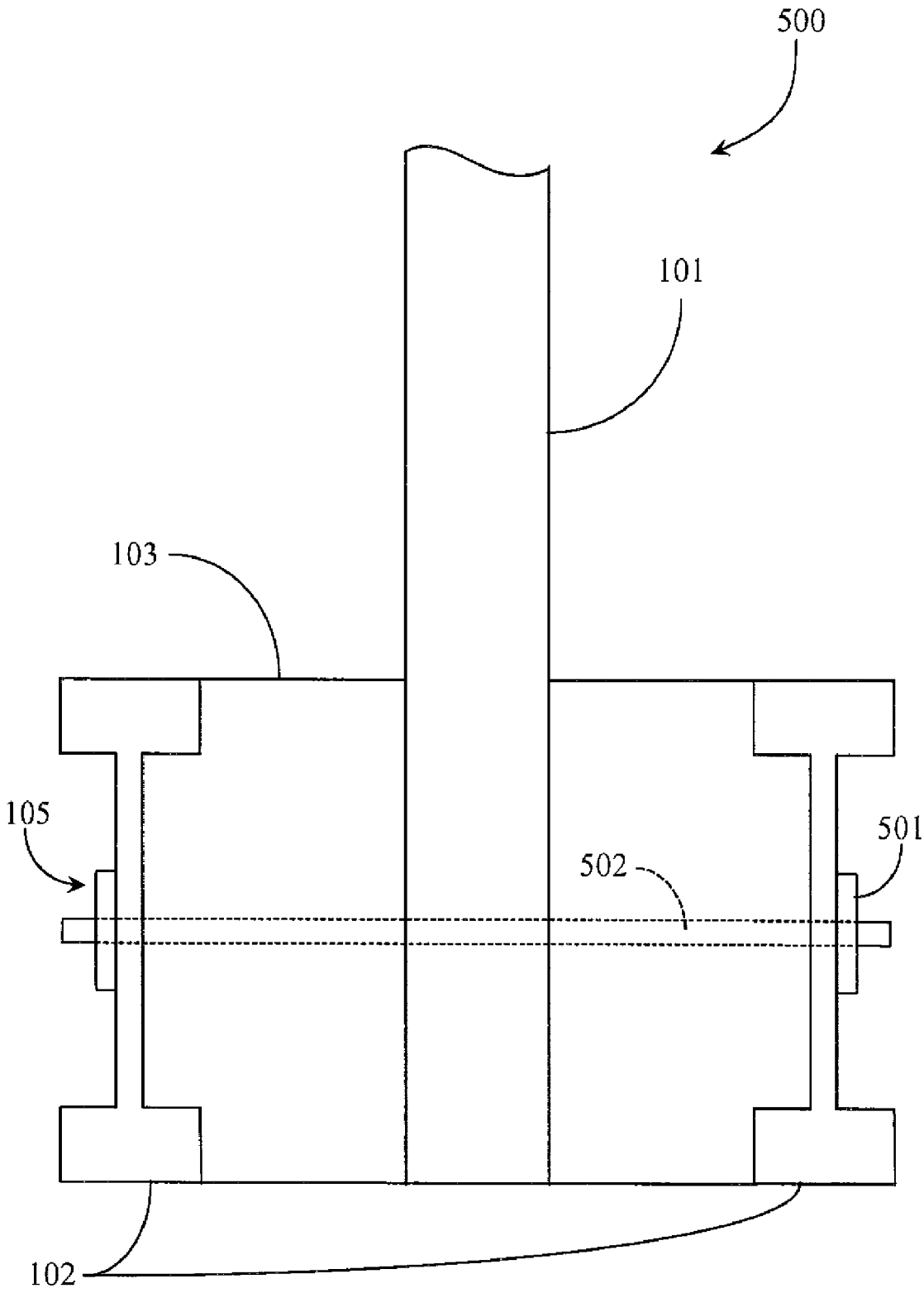
FIG. 5 is a plan view of a structural member assembly according to an embodiment of the invention.

FIG. 5 is a plan view of a structural member assembly 500 according to an embodiment of the invention. Structural member assembly 500 includes 2 horizontal structural members 102 spaced evenly apart in assembly from a vertical structural member 101 by 2 torsion locking blocks 103. In this example, the assembly is secured and compressed by compression system 105, which includes in this instance a rod 502 passing through the assembly and held in place by tensioning nuts 501 at either end of the assembly. Applying tension to the assembly provides the compression needed to ensure transfer of lateral shear and moment forces through the assembly, equally distributing the load.

Figure 6:
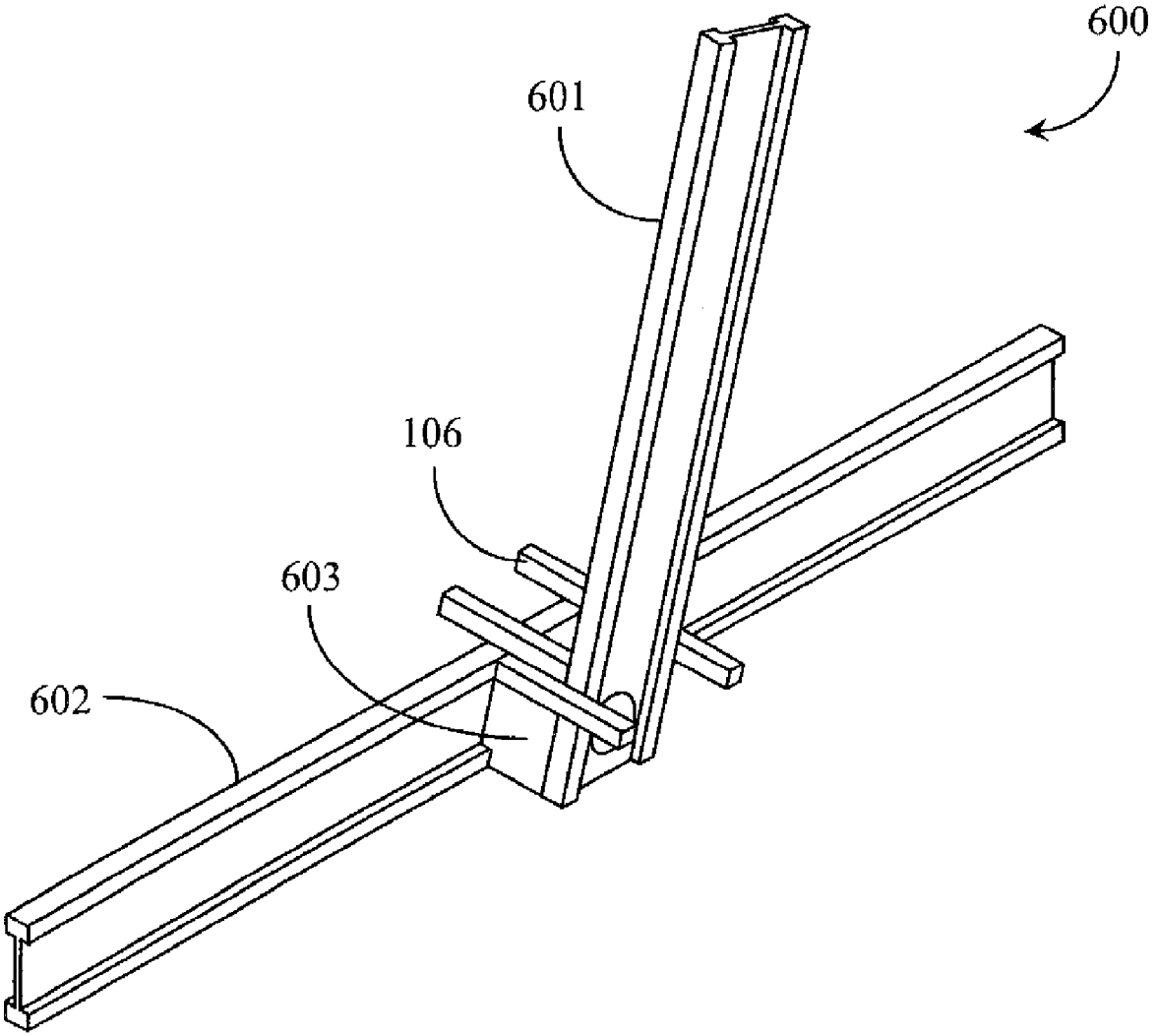
FIG. 6 is a perspective view of a structural member assembly locked at an angle other than 90 degrees.

FIG. 6 is a perspective view of a structural assembly 600 locked at an angle other than 90 degrees. Assembly 600 is implemented at an angle other than 90 degrees by using a torsion locking block 603 having channels orientated at an angle other than 90 degrees. In this case, a horizontal structural member 602 has a locking interface located approximately at a center point of the length of the member, rather than at one end of the member. Vertical structural member 601 may be identical to structural member 101 described earlier. However, in this embodiment, the ends of structural member 601 are angled according to the angle of block 603, instead of being cut off at a 90 degree angle. In this case, the angle of construction (linear angle formed by assembled structural members) will be the same angle set by the structural member locking blocks used in the assembly.

In this example, the frame construction may be that of an interior wall intersecting with a floor that rises at the particular angle set by the torsion locking blocks. Blocking devices 106 are shown in place for fastening to panel coverings described earlier.

Figure 7:
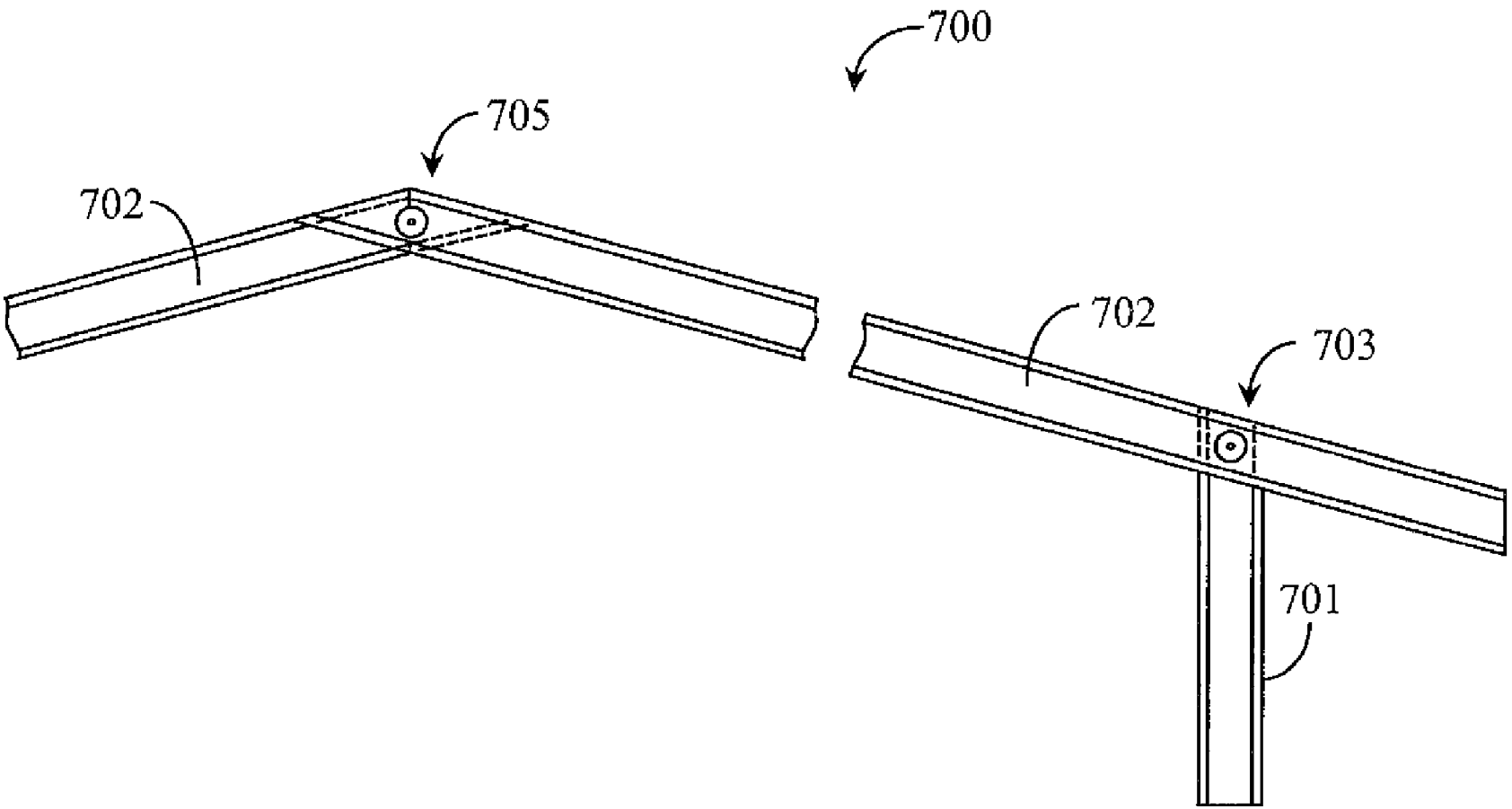
FIG. 7 is a plan view of an angled structural member assembly according to an embodiment of the invention.

FIG. 7 is a view of a structural member assembly 700 also according to an embodiment of the invention, comprising structural members 701 forming a wall structure, locked along interface 704 to members 702 forming a canted roof, with an optional eave extension as shown in the drawing. Interface 705 is a roof peak with one side of the roof locked to the other side using locking blocks (in this case diamond shaped to match the intersecting shapes of the members) and compression along the peak ridge. In this manner locking blocks may be provided having the appropriate engagement and locking angles for different roof angles, and structural members may be trimmed for length and end shapes to suit.

Figure 8A:
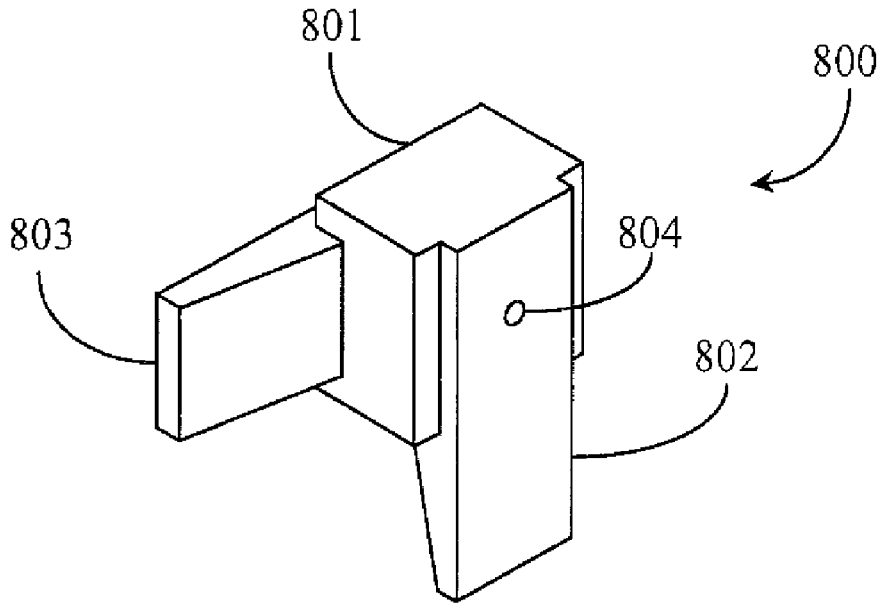
FIG. 8A is a perspective view of a torsion locking block according to another embodiment of the present invention.

FIG. 8A is a perspective view of a torsion locking block 800 according to another embodiment of the present invention. Block 800 has a main body 801 and tongues 802 and 803 extending off of the main body of the block. Block 800 may be formed of a single piece of steel, wood, fiberglass, or some other durable construction material. In one embodiment, main body 801 and tongues 802 and 803 may be separate components joined together to function as one piece. In this embodiment block 800 is of a single contiguous construction.

In this example, the sides of block 800 that interface with structural members are parallel to the end of each tongue 802 and 803. That is to say the surfaces lie in the same plane. The back surfaces of tongues 802 and 803 are angled so that the tongues are thicker at the base of main body 801 and thinner at their open ends. Under compression in assembly, the framing may be further strengthened somewhat by the extra footprint provided by tongues 802 and 803. The width dimension of tongues 802 and 803 is small enough to fit within the inside dimension between rails of the structural members so that the interfacing surface may be seated flush against the middle body of the structural members. A through opening 804 is provided in similar fashion as was described above for accepting a tensioning rod, cable or wire.

Figure 8B:
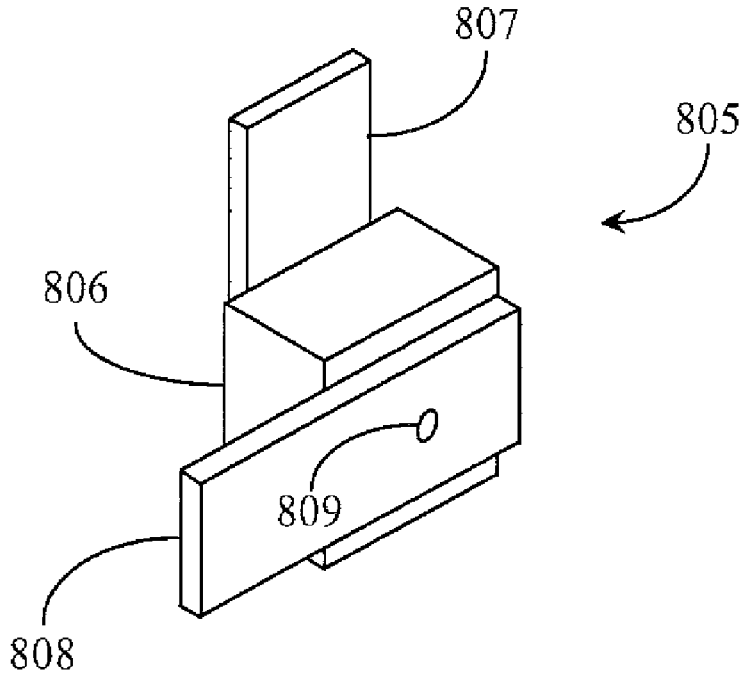
FIG. 8B is a perspective view of a torsion locking block according to another embodiment of the present invention.

FIG. 8B is a perspective view of a torsion locking block 805 according to yet another embodiment of the present invention. Block 805 has a main body 806 and includes tongues 807 and 808 that interface with structural members in similar fashion as tongues 802 and 803. Tongues 807 and 808 may be contiguously formed with main body 806 or they may be separate components joined to main body 806. In this variation, tongues 807 and 808 are of a uniform thickness from the open ends to main body 806. It is noted herein that block 800 and block 805 may be interchangeable in the same framing assembly without departing from the spirit and scope of the present invention. For example, block 800 may be placed in the portion of the assembly that bears more vertical load while block 805 may be suitable for portions of the assembly where there is less vertical load.

It will be apparent to one with skill in the art that locking blocks 800 and 805 may both be provided as blocks that present a construction angle that departs from 90 degrees, as has already been discussed above for block 103. Moreover, the overall thickness of block 103, block 800 or block 805 may be changed considerably so that structural members may be secured in the assembly having more or less separation, including structural members immediately adjacent or quite widely separated.

Figure 9:
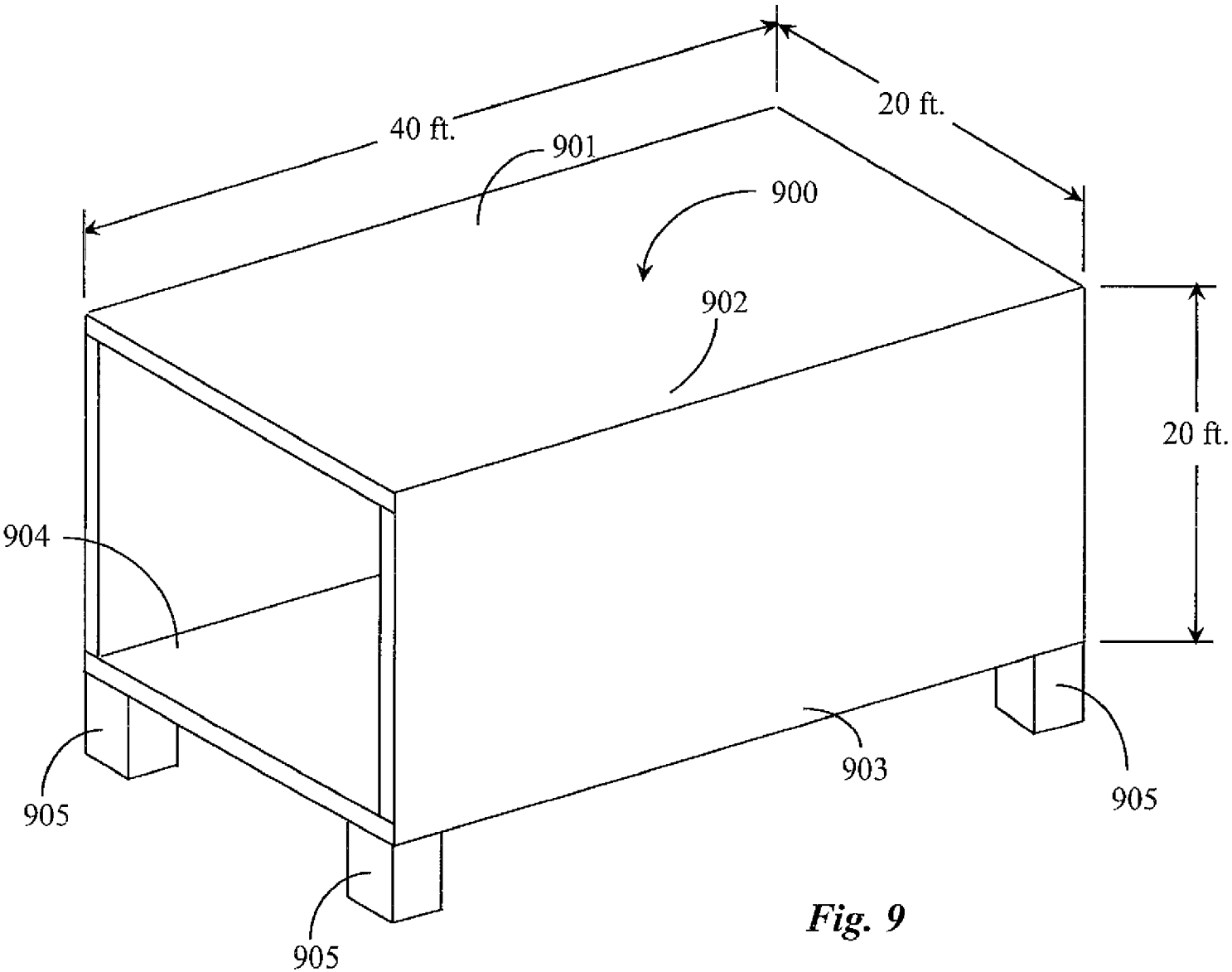
FIG. 9 is an illustration of a basic box structure according to an embodiment of the invention.

FIG. 9 illustrates a basic box structure 900 using the framing methods and elements of the invention, which may resist loads from any direction and simultaneous loads from multiple directions. Structure 900, including all of the components described and properly assembled and tensioned may require as few as 4 vertical supports 905 (three are visible in the perspective view) to the ground or to a supporting structure below. In this example, a simple rectangular structure 20 feet wide, 20 feet tall, and 40 feet long uses wooden I-structural members and the framing components described above for floors and roof members spaced at 16 inches on center, with the wall structural members made of the same or similar elements, shapes and spacing but offset from the floor structural members by approximately 8 inches center-to-center.

The top and floor are connected to the walls of the structure using torsion locking blocks according to an embodiment of this invention with a steel tension rod, wire or cable passing through the assembly at the intersections 901, 902, 903 and 904 of horizontal and vertical planes, from one end of the structure to the other end of the structure (40 foot length), and with appropriate tension applied. The top, floor, and walls of the structure are covered by plywood panels in this example, fastened using wood screws or nails, and the blocking components previously described along all of the panel edges completing the structural framing and form. The construction once formed according to the methods and apparatus of the invention is open on each end, although non-load bearing walls may be added including windows, doors, and other openings according to normal construction guidelines and rules. Doors, windows and the like may also be implemented in the long sides of the structure.

Structure 900 is a basic structure that may pre-fabricated and shipped to a building site, and used there as the basic unit for a home. Structure 900 may be placed on and secured to a foundation, or other simple supports as shown, and a roof and missing walls added by conventional structural techniques, providing a house much more resistant to natural forces than in the current art.

In one embodiment of the present invention, the components used for the framing may be pre-manufactured and then assembled forming the assemblies during the framing process at a building site. In another embodiment, entire flooring systems, roof systems, ceiling systems and walls may be assembled to specification and then the assemblies may be positioned and further assembled at the corners to secure the complete structure similar in some aspects to assembling a panelized construction. In alternative embodiments similar pre-loaded and pre-fabricated structures according to embodiment of this invention may be provided in a variety of sizes and shapes for a wide variety of purposes, such as storage structures, temporary housing units and the like, and for almost any construction purpose.

The methods and apparatus of the invention apply to wood construction and steel construction both residential and commercial. Lighter structures may be envisioned that may be fabricated of polymers, fiberglass, aluminum, and other materials depending on load requirements. There are many possibilities. Further it will be apparent to the skilled artisan that there may be many alterations made to the embodiments described as examples in this specification without departing from the spirit and scope of the invention. For example, structural members are shown in examples as I-beam shapes, and engaging geometry of locking blocks comprise edge channels in the blocks to engage the rails of the I-beam shapes. There are, however, a very wide variety of complementary engaging shapes that may be used, all of which are within the spirit and scope of the invention. There are similarly a wide variety of shapes and geometric variations that may be used beyond the simple example described herein. The apparatus and methods of the invention are useful for many sorts of construction where different surfaces may intersect. The invention for these and other reasons is limited only by the breadth of the following claims.

We claim:

1. A method for providing a four-sided reinforced static box frame as a basis for a building, the method comprising the steps of:

(a) forming a rectangular floor portion comprising a first plurality of parallel joists each spaced apart from adjacent joists of the floor portion by a common first dimension;

(b) forming a first wall portion comprising a second plurality of parallel joists each spaced apart from adjacent joists of the first wall portion by the common first dimension;

(c) forming a ceiling portion comprising a third plurality of parallel joists each spaced apart from adjacent joists of the ceiling portion by the common first dimension;

(d) forming a second wall portion comprising a fourth plurality of parallel joists each spaced apart from adjacent joists of the second wall portion by the common first dimension;

(e) joining the floor portion to the first wall portion at a first reinforced intersection at a right angle by positioning ends of the joists of the floor portion alternated with ends of the joists of the first wall portion, joining the alternated joists of the floor portion and the joists of the first wall portion by a torsion locking block exactly filling the space between each alternated joist, passing a locking bar or cable through the joined joists and locking blocks, and tensioning the bar or cable, compressing the reinforced intersection;

(f) joining the first wall portion to the ceiling portion at a second reinforced intersection at a right angle by positioning ends of the joists of the first wall portion alternated with ends of the joists of the ceiling portion, joining the alternated joists of the first wall portion and the joists of the ceiling portion by a torsion locking block exactly filling the space between each alternated joist, passing a locking bar or cable through the joined joists and locking blocks, and tensioning the bar or cable, compressing the second reinforced intersection;

(g) joining the ceiling portion to the second wall portion at a third reinforced intersection at a right angle by positioning ends of the joists of the ceiling portion alternated with ends of the joists of the second wall portion, joining the alternated joists of the ceiling portion and the joists of the second wall portion by a torsion locking block exactly filling the space between each alternated joist, passing a locking bar or cable through the joined joists and locking blocks, and tensioning the bar or cable, compressing the second reinforced intersection;

(h) joining the second wall portion to the floor portion at a fourth reinforced intersection at a right angle by positioning ends of the joists of the second wall portion alternated with ends of the joists of the floor portion, joining the alternated joists of the second wall portion and the joists of the floor portion by a torsion locking block exactly filling the space between each alternated joist, passing a locking bar or cable through the joined joists and locking blocks, and tensioning the bar or cable, compressing the second reinforced intersection, completing the reinforced four-sided box frame.

2. The method of claim 1 including a step for forming the torsion locking blocks and the joists to have complementary extensions and grooves to engage adjacent joists at a right angle, with the extensions and grooves engaged to resist rotation between the adjacent joists of joined portions.

3. The method of claim 1 further comprising a step for placing sheet paneling to cover some or all of external surfaces of the box frame.

4. The method of claim 3 further comprising the sheet paneling covering some or all of internal surfaces of the box frame.

5. The method of claim 1 comprising a step for forming one or both of framed doors or windows in one or both of the first or second wall portions.

6. The method of claim 1 further comprising a step for forming one or more internal wall structures to the box frame.

* * * * *